United States Patent [19]

Kloosterman

[11] Patent Number: 4,928,142

[45] Date of Patent: May 22, 1990

[54] COMBINATION ERASE DEVICE

[75] Inventor: David Kloosterman, Penfield, N.Y.

[73] Assignee: Eastman Kodak Company, Rochester, N.Y.

[21] Appl. No.: 252,321

[22] Filed: Oct. 3, 1988

[51] Int. Cl.[5] ..... G03G 21/00

[52] U.S. Cl. ..... 355/218; 355/228; 362/800

[58] Field of Search ..... 362/224, 311, 800, 11, 362/16, 17, 84, 223, 351, 355; 355/67, 70, 71, 218, 228, 229, 239, 1

[56] References Cited

U.S. PATENT DOCUMENTS

| | | | |
|---|---|---|---|
| 4,152,618 | 5/1979 | Abe et al. | 362/800 X |
| 4,248,517 | 2/1981 | Nishikawa | 362/16 X |
| 4,305,650 | 12/1981 | Knox | 355/218 |
| 4,344,691 | 8/1982 | Grant et al. | 355/218 X |
| 4,716,436 | 12/1987 | Lang | 355/218 |
| 4,794,421 | 12/1988 | Stoudt et al. | 355/218 X |

FOREIGN PATENT DOCUMENTS 0168275 10/1982 Japan .

*Primary Examiner*—A. T. Grimley
*Assistant Examiner*—Robert Beatty
*Attorney, Agent, or Firm*—Tallam I. Nguti

[57] ABSTRACT

A device for erasing charges from an area of a charged electrophotographic image-bearing member includes a light source mounted on an electroluminescent (EL) panel which has a slot and semi-transparent members that project partially into the slot. Light from the source is restricted to passage through the slot where the semi-transparent members serve to reduce the intensity of part of the light resulting in light of different intensities impinging on the area being erased.

7 Claims, 2 Drawing Sheets

COMBINATION ERASE DEVICE

This invention relates to devices for removing charges from the photoconductor of an electrophotographic copier or printer, and more particularly to an improved device for removing charges from the interframe areas on such photoconductors in such a way as to produce soft contrast, toner-free borders on produced copies.

The electrophotographic process, employed in copiers and printers for producing copies of a document, is now well known. It includes the steps of uniformly charging a photoconductor with electrostatic charges at a charging station, creating an electrostatic image by imagewise exposing the photoconductor, toning such image at a development station, and transferring the toned image onto a receiver where the image is then fused to form the copy. Typically, the photoconductor is in the form of a continuous loop that is divided into several image frame areas separated by narrow interframe areas.

In order to obtain a good quality copy of only the image in a document being copied, it is well known in the art to selectively and separately discharge or erase charges from any non-image areas on the photoconductor, such as the top and bottom borders of the image frame areas, and the interframe areas. Devices that can be turned on and off precisely for discharging such areas are disclosed, for example, in U.S. Pat. No. 3,784,301 and U.S. Pat. No. 4,716,436.

These particular devices which must be located between the charging station and the development station, are turned on and off to expose only desired widths of the border areas of each image frame. As disclosed, care is taken in the design and operation of such devices to prevent their light from undesirably discharging any portion of the actual image area. Unfortunately, however, concentrating the light from such a device in the border area can create an undesirable copy defect in the form of a white line or a very sharp contrast between the discharged border and the image area.

In addition, as disclosed for example in commonly assigned U.S. Pat. No. Re. 32,259 issued Oct. 7, 1986 to Kasper et al., the quality of some copies can be improved if the images are produced as halftone, not continuous tone images. To produce such halftone images, green light, for example, is projected from behind a relatively transparent photoconductor that includes a dot screen layer, and allowed to impinge on and shine through red dots on the screen layer to the photoconductive layer. To be effective, this green light producing device must be located, right along with all the other erase devices, between the charging station and the development station of the copier or printer. In small copiers and printers where space is generally at a premium, proper and effective positioning of these various erase devices, between the charging and development stations, is a problem.

SUMMARY OF THE INVENTION

It is an object of the present invention to provide a border erasing device that produces soft contrast and toner-free borders on copies.

It is also an object of the present invention to provide a combination device that saves space between the charging station and development station by both erasing charges from border areas of the photoconductor and exposing a halftoning dot screen layer on the photoconductor.

In accordance with the present invention, a panel that has an opaque backside, and that includes a slot extending the full width of a photoconductor, is supported in close proximity to the photoconductor. The panel has semi-transparent members that project partially into the slot. A light source for erasing charges from a border area of the photoconductor is disposed behind the panel. Light from the source is restricted to passage through the slot where some of it passes through the semi-transparent members, thereby resulting in light of different intensities impinging on the area being erased.

Erasing charges from the border area in this manner preferably produces borders (on copies) that are not only toner-free, but that present a soft and gradual contrast against the image area. In a specific embodiment of the present invention, the slotted panel is an electroluminescent (EL) panel such as the type suitable for producing halftone images in a copier or printer that includes a photoconductor with a dot screen layer. The combination device of the present invention advantageously saves space between the charging and development stations, and is especially useful in small, compact copiers and printers.

BRIEF DESCRIPTION OF THE DRAWINGS

In the detailed description of the preferred embodiment of the invention presented below, reference is made to the accompanying drawings in which.

DESCRIPTION OF THE PREFERRED EMBODIMENTS

Figure 1:
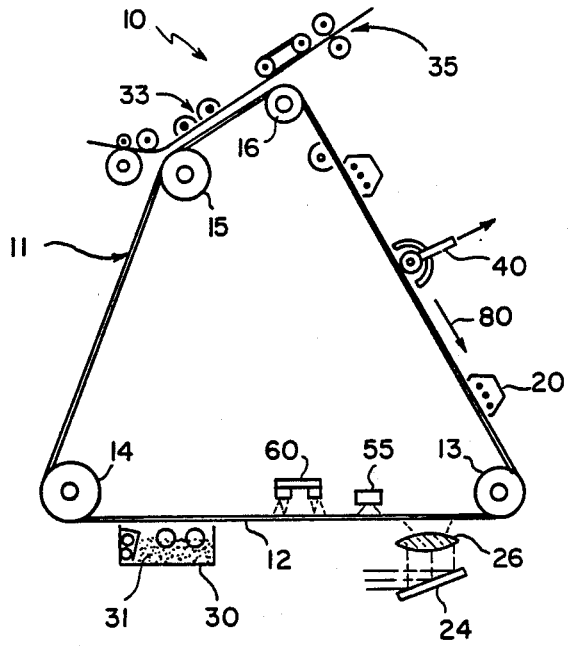
FIG. 1 is a schematic view of the imaging loop of an electrophotographic copier or printer incorporating the charge erasing device of the present invention.
Figure 1A:
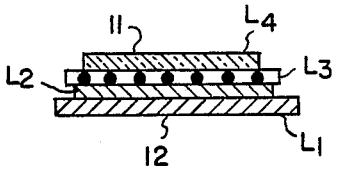
FIG. 1A is a sectional illustration of a photoconductor having a dot screen layer.

A preferred embodiment of the present invention is illustrated in the drawings, in connection with an electrophotographic copier or printer employing an endless flexible belt photoconductor of sufficient length to accommodate a plurality of image frames separated by interframe areas. As depicted in FIG. 1, an electrophotographic copier or printer 10 includes an endless, flexible belt photoconductor 11 that has a charge/image bearing surface 12. The photoconductor 11 is trained about rollers 13, 14, 15 and 16 for movement by drive roller 13 in the direction of the arrow 80. As illustrated in FIG. 1A, the photoconductor 11 which is relatively transparent, may include a photoconductive layer L1, a conductive layer L2, a dot screen layer L3 and a back support layer L4. Typically, the photoconductor 11 is about fourteen and a half (14.5") inches wide and is in the form of a continuous loop that is divided into several image frame areas separated by interframe areas.

To make permanent copies of a document using the copier or printer 10, a primary charger at a charging station 20 continuously and uniformly charges the charge/image bearing surface 12 of the photoconductor 11. An electrostatic image can then be formed on an image frame of the charged photoconductor by imagewise exposing the photoconductive layer to light such as light reflected from the background of an exposed document (not shown) using a mirror 24 and lens 26. Such exposure discharges areas on the photoconductor 11 that are equivalent to the background areas of the image being copied, thereby leaving an undischarged pattern equivalent to the total of the image being copied, and any unexposed areas within the particular image frame area. Within the areas discharged, the degree of discharge depends directly on the amount and intensity of light impinging on such area.

The electrostatic charge pattern created thus, may next move, as is, to a development station 30 where charged toner particles 31 are attracted and held, forming a continuous and uniformly toned image of the pattern. Within the image frame, the toner particles are attracted to areas in direct proportion to the quantity of charges in each area or in other words, in indirect proportion to the degree of discharge of the area. The visible image of the pattern formed is then transferred, at a transfer station 33, to a suitable receiver such as a copy sheet of paper. Subsequently, the transferred image is fused to the receiver at a fusing station 35, forming a permanent copy. The image frame from which the toned image was transferred next moves through a cleaning station 40 where it is cleaned in preparation for reuse, starting again with continuous and uniform charging at the charging station 20.

It is known in the art that to produce a quality copy of an image from a document, the pattern of electrostatic charges within an image frame being developed at the development station 30, should represent no more than the image itself. To achieve this, charge erasing devices 55 and 60 are positioned upstream of the development station for erasing any charges within intended or non-image areas such as the top and bottom borders, and the interframe areas of the photoconductor. Erasing device 55, generally referred to as a format erase, may consist of red light incandescent lamps that are selectively activated to erase the top and bottom borders of the image frame. On the other hand, charges within the side borders or interframe areas of the image frames are erased by the combination device of the present invention, generally designated 60.

Figure 2:
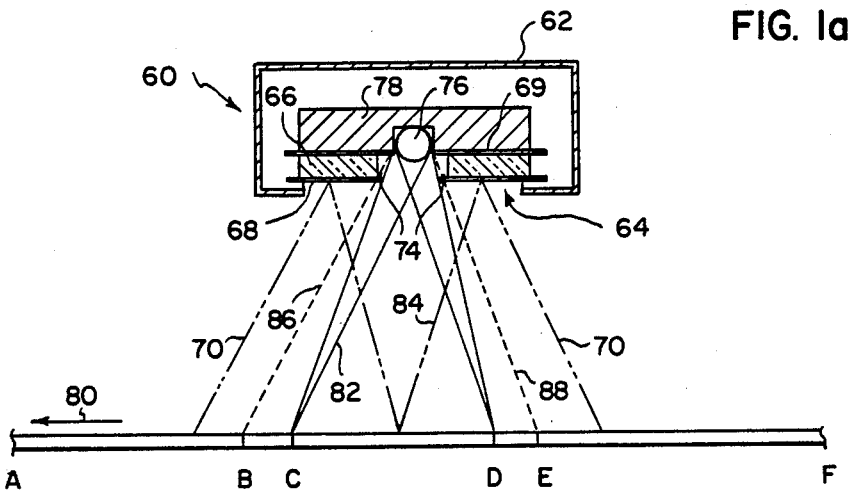
FIG. 2 is an enlarged cross-sectional schematic of the present invention in full exposure mode against the backside of the photoconductor.
Figure 3:
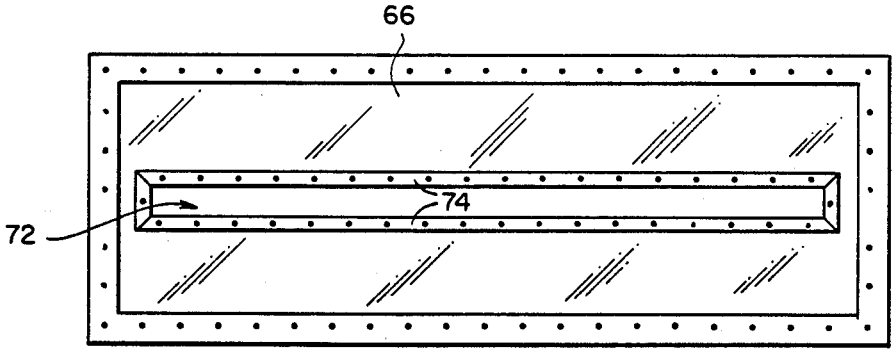
FIG. 3 is a frontside view of the slotted electroluminescent panel sealed in semi-transparent material.
Figure 4:
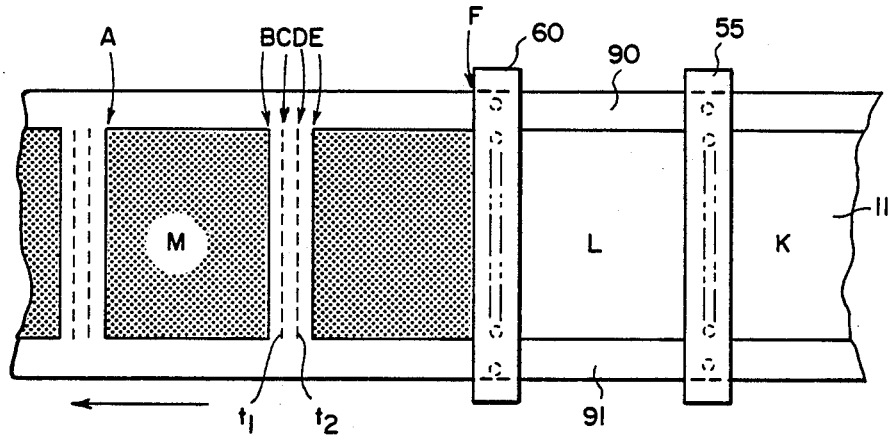
FIG. 4 is a backside view of the photoconductor passing under the charge-erasing devices.

Referring now to FIGS. 2 through 4, the device 60 includes supporting means such as an elongate shroud 62 that has an opening 64. The shroud 62 is located across the width of, and on the backside of, the photoconductor 11 such that the opening 64 is adjacent and facing the back of the photoconductor. An electroluminescent panel 66 consisting of a phosphor material sandwiched between front and backside electrical conductors 68, 69 is supported within the shroud across the opening 64. The backside conductor 69 is made opaque, but the frontside conductor which faces the back of the photoconductor, is substantially transparent. When an A.C. voltage (not shown) is applied between the conductors 68, 69, the panel 66 acts as a lamp, producing and projecting green light rays 70, for example, which may be used for exposing the photoconductor 11 from the backside (FIG. 2).

During such exposure, complimentary red ink dots on the dot screen layer L3 of the photoconductor absorb and prevent the green light from shining through the photoconductive layer L1 in areas covered by the dots. Only the light falling on areas not covered by dots shines through the photoconductive layer where it discharges equivalent areas. The net result is a charge pattern M (FIG. 4) on the photoconductive layer that is no longer a continuous and uniform pattern K, as was initially produced at the charging station, but a pattern (M) that is defined instead by the dots on the dot screen layer. Instead of using green light and complimentary red dots, similar results can also be obtained by using red light and complimentary cyan colored dots on the dot screen layer. In any case, when the dots formed on the photoconductor in this manner are developed with conductive developer materials, the size of each dot increases proportional to the original quantity of electrostatic charge or latent image voltage in the dot area. Developed dots varying in size and gray level are thereby produced rendering an image with characteristics that are substantially similar to those of lithographically produced halftone images.

As illustrated in FIGS. 2 and 3, the panel 66 also includes a slot 72 (FIG. 3) extending the full width of the photoconductor 11. The slot 72 is preferably narrower than the in-track dimension of an area on the photoconductor, such as the interframe area, that is to be discharged. In addition, panel 66 is sealed in semi-transparent material which forms semi-transparent members 74 that project partially into the slot 72 (FIG. 3). The members 74 are formed and trimmed such that the thickness of each projection decreases away from the edge of the slot. Within the slot 72, the members 74 are spaced so as to leave the center area of the slot completely open and unobstructed.

For discharging, for example, an interframe area of the photoconductor, the device 60 further includes a light source 76, with a support frame 78, mounted directly over the slot 72. As such, the opaque backside 69 of the panel 66 contacts the frame 78 to form an effective mask to light from the source 76, and restricts passage of such light to the slot 72. As a consequence, the source 76 can be made without a separate and/or independent mask and supporting means, and hence, can be made less expensively. Since the dots on the dot screen layer L3 are formed in red ink, the light from the source 76 should preferably be light that will not be absorbed by red dots, for example, red light. The source 76 can therefore be an array of red light emitting diodes (LED's), or a xenon-flash type lamp.

As depicted in FIG. 2, with the photoconductor 11 moving in the direction of the arrow 80 past the device 60, the light source 76 can be turned on and off to erase each narrow interframe area, for example, the area BE (FIG. 4). Referring still to FIG. 4, in the interframe area BE which includes the trailing edge of the image frame AB and the leading edge of the image frame EF, the lines B and E represent the image limits on these respective frames. Ordinarily, light from the source 76 is of such strength and intensity that it is capable of fully discharging the interframe area BE. However, some of the overall rays 82 (CE) and 84 (BD) from the source 76, before reaching the photoconductor 11, pass through the semi-transparent members 74. In so doing, the intensity of such rays 86, 88 (FIG. 2) is significantly and gradually reduced towards the edges of the slot 72 in direct relation to the increasing thickness of the members 74.

When the source 76 is turned on and off, these rays of reduced intensity 86, (BC) and 88, (DE) fall as precisely as possible on the lines B and E, at the limits of images on the adjoining image frames, and then range with increasing intensity towards the center point of the interframe area BE. However, within a portion CD (where the members 74 do not extend) in the area BE, light from the source 76 falls undiminished in intensity onto the photoconductor, thereby fully and uniformly discharging such portion CD.

The effect of the semi-transparent members 74, within the slot 72, is therefore to produce partially and variably discharged portions BC and DE in addition to the fully discharged portion CD within the interframe area BE.

The operation of the present invention can now be described as follows. As shown in FIG. 4, a fully charged and unexposed photoconductor 11 on approaching the discharging area which includes the devices 55, 60, will have a continuous pattern of charges K across the entire photoconductive surface 12 (FIG. 1). There, the photoconductor first may be imagewise exposed to form an image that consists of a continuous pattern of charges. The photoconductor then moves past the format erase device 55 which discharges the top and bottom borders 90, 91 of the image frames, resulting in a truncated pattern of charges L. As the image frame with the truncated pattern of charges moves under the combination device 60 in the direction of the arrow 80, the device 60 may be operated in full exposure mode or in the alternative mode. In the full exposure mode, both the EL panel and the interframe erase lights are activated. Alternatively, in the alternative mode only the format erase light may be activated. In the full exposure mode, the green light producing EL panel 66, energized by the A.C. source (not shown), continuously exposes the photoconductive layer to the red dot pattern of the dot screen layer. Such exposure converts an otherwise continuous pattern of charges L, into a dot pattern of charges M (FIG. 4). In addition, the red light producing interframe erase component of the device 60, source 76, is meantime readied for effectively erasing charges from the side border areas, for example, the area BE.

To erase an area such as BE, the light source 76 is turned on at a time t1, just when the rays of reduced intensity 86 will fall on the moving photoconductor starting from the line B. The rays 86, as such, will partially and variably discharge the portion BC of the area BE. During the period the source 76 is on, unimpeded rays from it will fall on the portion CD of the area BE fully and uniformly discharging such portion CD. As the area BE continues to move past the device 60, the source 76 will eventually be turned off at a time t2, just when the rays of reduced intensity 88 would have reached the line E. At such time t2, the rays 88 would have partially and variably discharged the portion DE of the area BE. The overall result of such erasure is an interframe area BE that has been variably discharged, and accordingly, will variably attract some toner particles at the development station. A copy produced utilizing this manner of erasure, will present a preferably soft and gradually contrasting trailing border to the image formed on a leading image frame, for example, (AB), and a similar leading border to the image formed on a trailing image frame, for example, (EF). In addition, the device of the present invention also provides space and component saving advantages, by effectively combining otherwise multiple devices, and by reducing the number of parts required for such combination. The combination device of the present invention, therefore, is particularly suitable for use in even small compact copiers and printers in which space is limited.

Although the above detailed description has been made with particular reference to a preferred embodiment, it will be understood that variations and modifications can be effected within the spirit and scope of the present invention.

What is claimed is:

1. A combination in an electrostatographic copier or printer having a moving photoconductor that includes image frame areas, interframe areas, and a halftoning dot screen layer, the combination comprising:

(a) an electroluminescent panel supported adjacent to, and crosswise behind the photoconductor, producing light that can be absorbed by the dot screen layer and thereby selectively discharging areas on the photoconductor;

(b) a slot in said electroluminescent panel extending the full width of the photoconductor;

(c) semi-transparent members, formed by a semi-transparent material sealing the electroluminescent (EL) panel, said members projecting partially into said slot; and (d) a source of light, for exposing a selected area of the photoconductor, suitably producing light that can pass substantially unabsorbed by the dot screen layer, said source of light being mounted on and behind said electroluminescent panel such that its light is restricted to passage through the semi-transparent members and the unobstructed portion of said slot.

2. In an electrostatographic copier or printer, a device for erasing charges from a photoconductor that includes image frame areas, interframe areas, and a backside halftoning dot screen layer, the erasing device comprising:

(a) an electroluminescent (EL) panel producing a first light for exposing the entire backside of the photoconductor so as to erase charges in portions of the photoconductor not covered by halftoning dots of the dot screen layer, said EL panel consisting of a phosphor material sandwiched between a transparent frontside electrical conductor and an opaque backside conductor, and being supported crosswise and adjacent to the backside of the photoconductor;

(b) a slot in said electroluminescent panel extending the full width of the photoconductor; and (c) an interframe erase unit consisting of a frame, and an array of light emitting diodes (LED) suitable for selectively erasing charges from all portions of an interframe area including portions covered by halftoning dots of the dot screen layer, said interframe erase unit being connected to said opaque backside conductor of said EL panel such that passage of light from said LED array of said interframe erase unit is restricted to said slot in said EL panel.

3. The device of claim 2 wherein said EL panel is sealed in semi-transparent material forming a semi-transparent member that projects partially into said slot, creating an obstructed portion at an edge of said slot, as well as, an unobstructed portion thereof, such that said light from said interframe erase unit partially passes through said semi-transparent member within said obstructed portion of said slot.

4. The device of claim 2 wherein said slot in said panel is narrower than the dimension of a unit area of the photoconductor from which charges are being erased.

5. The device of claim 3 wherein said panel has a plurality of said semi-transparent members associated correspondingly with different edges of said slot.

6. In an electrostatographic copier or printer, an interframe erase unit for erasing charges from the interframe areas of a photoconductor that includes a backside halftoning dot screen layer and image areas separated by interframe areas, the interframe erase unit comprising:

(a) a frame supportable crosswise and adjacent to the backside of the photoconductor;

(b) a first light source mounted to the front side of said frame, said light source producing light suitable for selectively erasing charges from all portions of an interframe area of said photoconductor including portions covered by halftoning dots of the dot screen layer; and (c) a mask member having a slot therein, said mask member being mounted to said front side of said frame such that passage of light from said first light source is restricted to said slot, and said mask member consisting of an electroluminscent (EL) panel constituting a second light source for erasing charges in portions of the photoconductor not covered by halftoning dots of the dot screen layer.

7. The interframe erase unit of claim 6 wherein said first light source consists of an array of light emitting diodes (LEDS).

* * * * *